US007129908B2

(12) United States Patent
Edward et al.

(10) Patent No.: US 7,129,908 B2
(45) Date of Patent: Oct. 31, 2006

(54) LIGHTWEIGHT ACTIVE PHASED ARRAY ANTENNA

(75) Inventors: Brian J. Edward, Jamesville, NY (US); George A. Johnson, Dewitt, NY (US); Earl L. Turner, Liverpool, NY (US)

(73) Assignee: Lockheed Martin Corporation, Bethesda, MD (US)

( * ) Notice: Subject to any disclaimer, the term of this patent is extended or adjusted under 35 U.S.C. 154(b) by 39 days.

(21) Appl. No.: 10/863,028

(22) Filed: Jun. 8, 2004

(65) Prior Publication Data

US 2005/0270250 A1 Dec. 8, 2005

(51) Int. Cl.
*H01Q 1/12* (2006.01)

(52) U.S. Cl. ..... 343/878; 343/890; 343/879; 343/877

(58) Field of Classification Search ..... 343/878
See application file for complete search history.

(56) References Cited

U.S. PATENT DOCUMENTS 5,099,254 A * 3/1992 Tsukii et al. ..... 343/853
5,854,607 A * 12/1998 Kinghorn ..... 343/853
5,913,888 A * 6/1999 Steinmeyer et al. ..... 62/51.1
6,457,859 B1 * 10/2002 Lu et al. ..... 378/199
6,927,980 B1 * 8/2005 Fukuda et al. ..... 361/700

* cited by examiner

*Primary Examiner*—Don Wong
*Assistant Examiner*—Binh van Ho
(74) *Attorney, Agent, or Firm*—Plevy, Howard & Darcy PC

(57) ABSTRACT

A lightweight active phased array antenna including modular active electronics assemblies and passive radiating element aperture panels that are integrated into a lightweight support structure of a minimum depth which provides a cooling system for the electronics assemblies. The electronics assemblies and aperture panels are fully accessible from one or both faces of the antenna and can be readily removed/replaced as required.

30 Claims, 4 Drawing Sheets

LIGHTWEIGHT ACTIVE PHASED ARRAY ANTENNA

FIELD OF THE INVENTION

This invention relates to radar systems, and more particularly, to a lightweight active phased array antenna with forced convection cooling.

BACKGROUND OF THE INVENTION

Mission requirements for near-future radars dictate high levels of operational capability provided by systems that are light in weight. Such radars must feature agile, reconfigurable beams coupled with high effective transmit power and high receive sensitivity.

The operational requirements are fulfilled by adopting large aperture active phased array antennas having transmit/receive (TIR) electronics distributed with the radiating elements. Distributing the active TIR circuits over the array antenna also necessitates distributing their associated prime power converters and controllers, plus providing means for effective thermal management and conveying RF/power signals. It is desirable that these phased array antennas be realized with minimum weight to promote high mobility in ground radar applications and to minimize top-side mass for shipboard systems.

Accordingly, there is a need for a lightweight active phased array antenna having distributed transmit/receive (T/R) electronics radiating elements, power converters, and controllers. Such a phased array antenna should also have effective thermal management and a mechanism for conveying the RF/power signals.

SUMMARY OF THE INVENTION

According to an aspect of the invention, a lightweight active phased array antenna comprises modular active electronics assemblies and passive radiating element aperture panels that are integrated into a lightweight support structure of a minimum depth, which provides a cooling system for the electronics assemblies. The electronics assemblies and aperture panels are accessible from one or both faces of the antenna and can be readily removed/replaced as required.

DETAILED DESCRIPTION OF THE INVENTION

Figure 1:
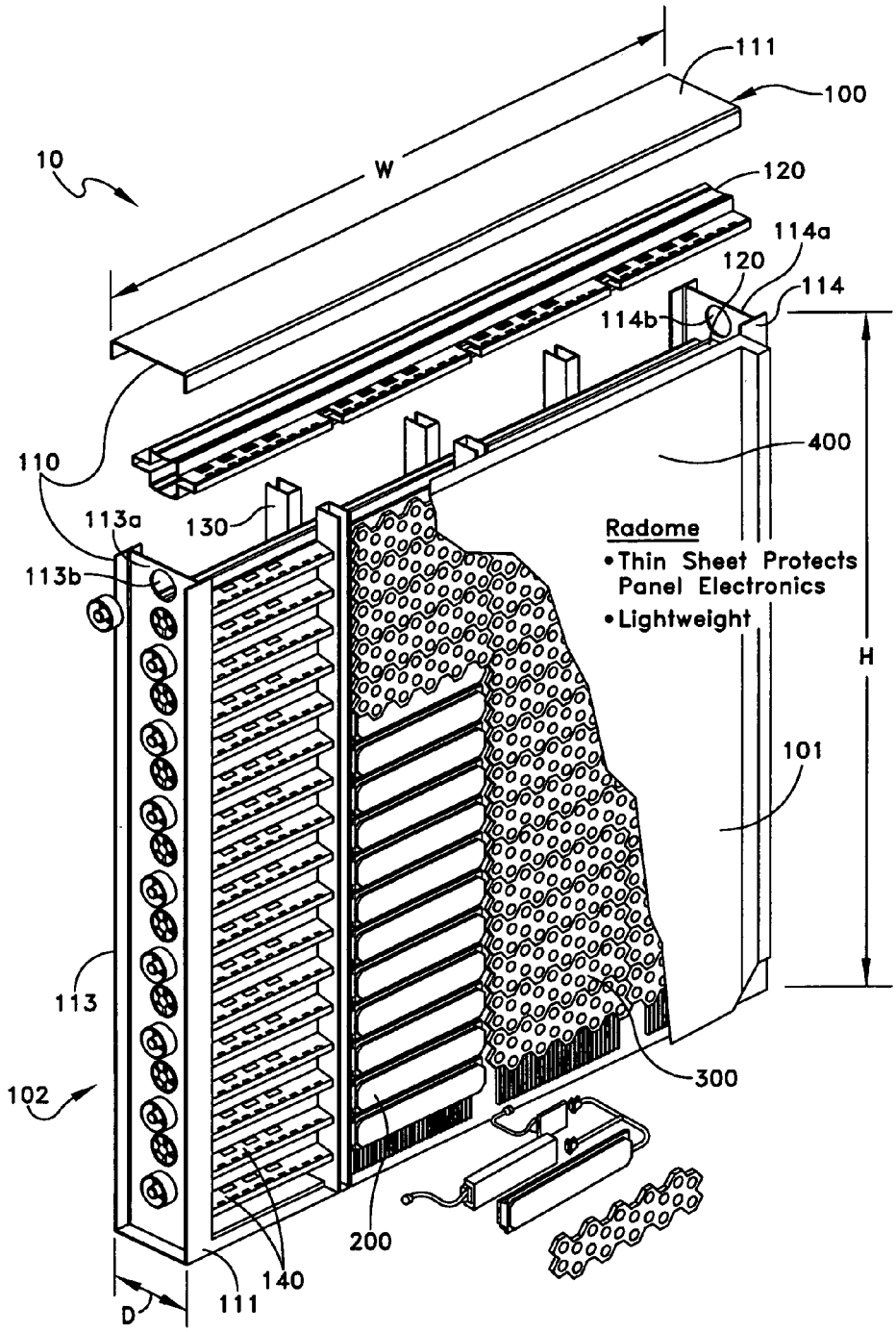
FIG. 1 is a perspective view of an exemplary embodiment of a lightweight active phased array antenna according to an embodiment of the present invention.

FIG. 1 shows an exemplary embodiment of a lightweight active phased array antenna according to an embodiment of the present invention. The lightweight active phased array antenna, denoted by numeral 10, comprises a rigid, lightweight support structure 100 having a first side 101 and a second side 102, and a plurality of modular, active electronics assemblies 200 and modular passive radiating element aperture panels 300 disposed on the first and second sides 101, 102 of the support structure 100. A thin sheet-style radome 400 is attached directly to the aperture panels 300 disposed on each of the first and second sides 101, 102 of the support structure 100, thereby protecting the aperture panels 300 from weather, chemical, and mechanical damage, and rejecting the majority of incident solar radiation.

The support structure 100 comprises a perimeter frame 110, a plurality of stacked, duct-like horizontal cross members 120 which are secured together by the perimeter frame 110, and a plurality of intermediate, channel-shape vertical column members 130 that provide additional stiffness to the support structure 100 and form bays 140 on both the first and second sides 101, 102 of the structure 100 into which the modular active electronics assemblies 200 are mounted. The modular passive radiating element aperture panels 300 may be mounted to the modular active electronics assemblies 200 mounted in the bays 140. The perimeter frame 110 may include an upper channel member 111, a lower channel member 112, and first and second side I-beam members 113 and 114 extending between the upper and lower channel members 111, 112. The first and second side I-beam members 113, 114 each include a central web portion 113*a*, 114*a* having a plurality of fan mounting apertures 113*b*, 114*b* formed therein.

The entire support structure 100 may be fabricated from a carbon-epoxy composite, which provides exceptional stiffness to weight characteristics. Alternatively, the entire support structure 100 may be fabricated from a low mass density metal alloy, such as aluminum. Still further, some of the members of the support structure 100 may be fabricated from the carbon-epoxy composite and other members of the support structure 100 may be fabricated from the low mass density metal alloy. In one exemplary embodiment, the support structure may have a width W of about 92 inches, a height H of about 87 inches, and a depth D of about 11.5 inches. Support structures of other dimensions are also contemplated.

A back-to-back, dual-face phased array antenna may be realized using the shown support structure 100 which includes the bays 140 on both the first and second sides 101, 102 thereof and the modular active electronics assemblies 200 (mounting the modular passive radiating element aperture panels 300) mounted in the bays 140 on both the first and second sides 101, 102 of the structure 100. Although not shown, a single-face phased array antenna may also be realized using an embodiment of the support structure 100 that includes the bays 140 on only one of the first and second sides 101, 102 thereof for mounting the modular active electronics assemblies 200 (and the modular passive radiating element aperture panels 300 mounted to the electronics assemblies 200).

Figure 2:
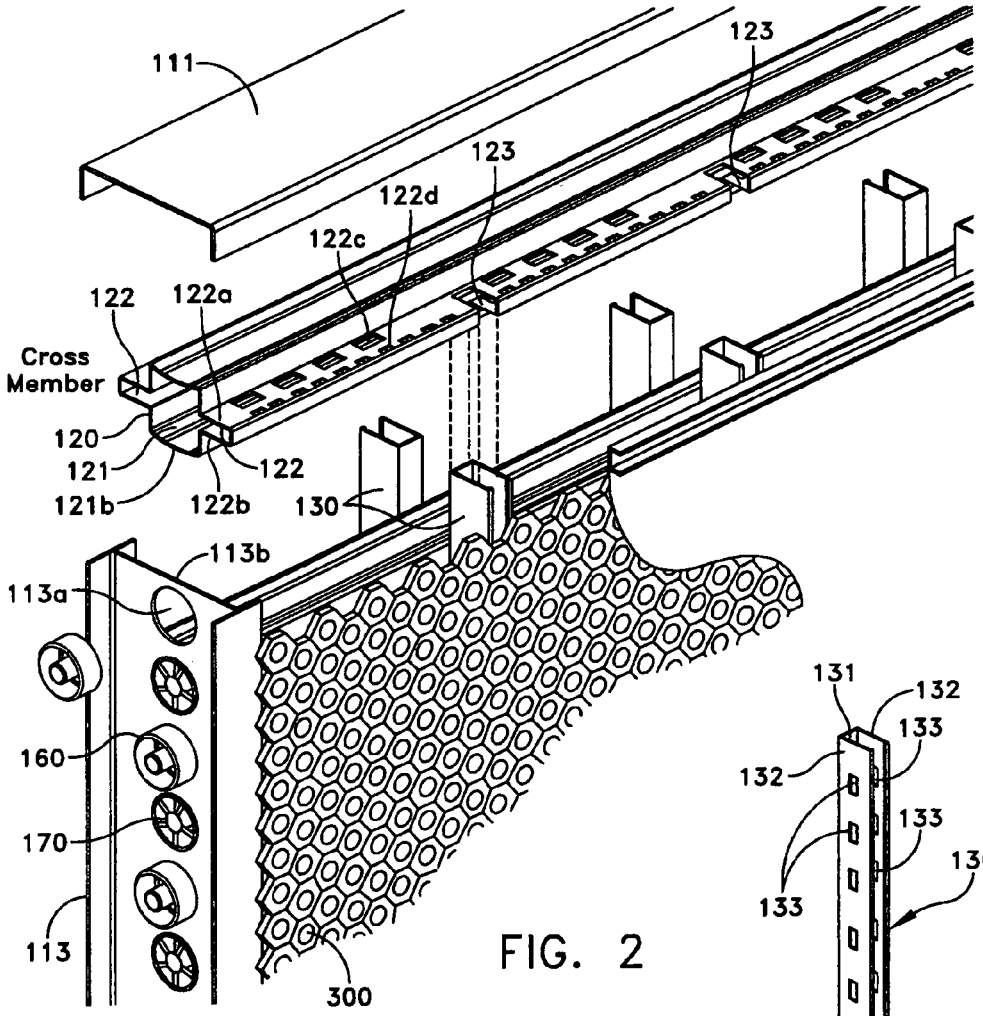
FIG. 2 is an enlarged perspective view of the lightweight active phased array antenna.
Figure 3:
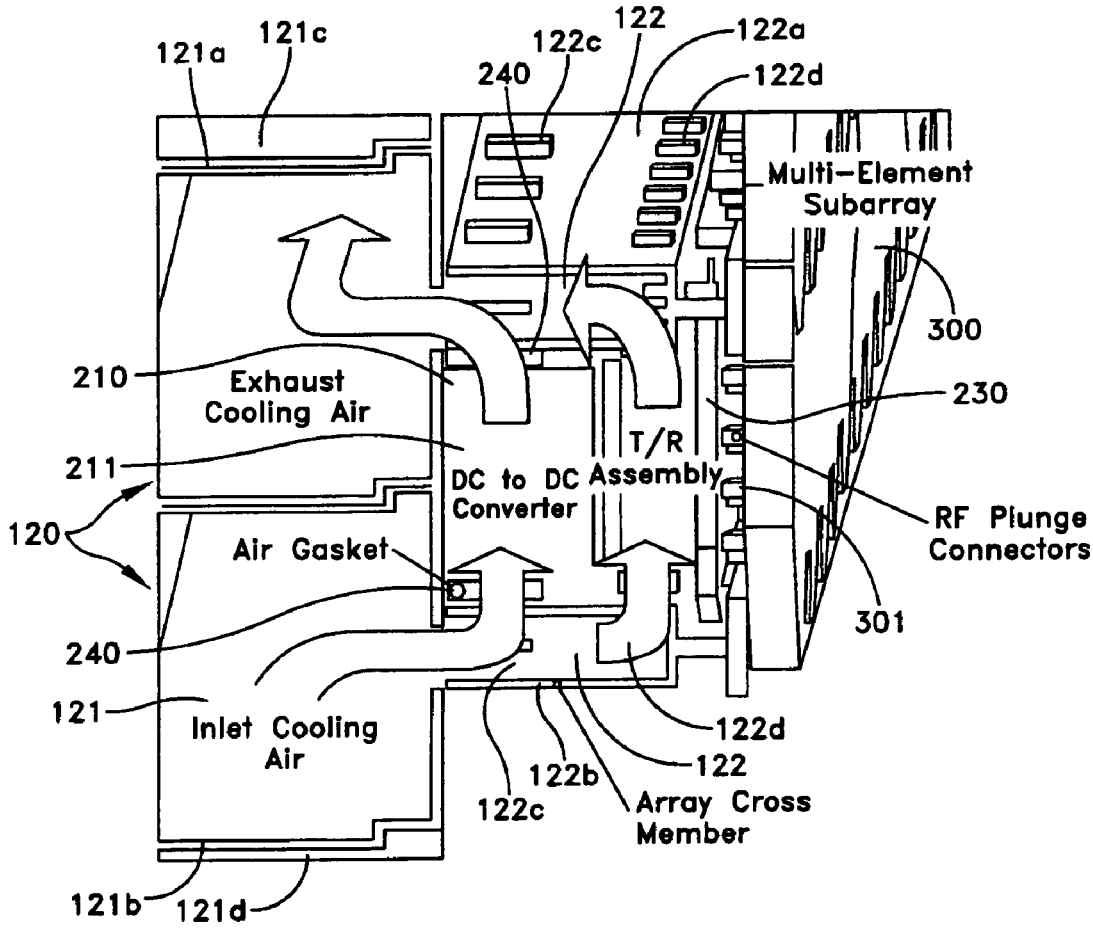
FIG. 3 is a sectional view through two stacked, duct-like horizontal cross members of the antenna's support structure.

As best shown in FIGS. 2 and 3, the support structure's horizontal, duct-like cross-members have a "bow tie" sectional shape formed by a central main duct 121 and laterally extending, wing-like secondary ducts 122 that communicate with the central, main duct 121. The upper and lower walls

122*a,* 122*b* of the secondary ducts 122 include inner and outer air metering apertures 122*c* 122*d.* The duct-forming design of the horizontal cross-members allow them to distribute a coolant, preferably air, to the array's modular active electronics assemblies 200. In the case of an air coolant, intake cooling fans 160 and exhaust cooling fans 170 are placed at the ends of the horizontal cross-members, in the fan mounting apertures 113*b,* 114*b* of the side I-beam members 113, 114, to direct ambient or conditioned inlet or intake air into, and exhaust air out of the phased array antenna. The vertical stack of horizontal cross-members form alternating "intake" and "exhaust" ducts. As shown in FIG. 3, the lower wall 121*b* of the central duct portion 121 may be formed with an outdent 121*d* and the upper wall 121*a* of the central duct portion 121 may be formed with a correspondingly shaped indent 121*c* to maintain vertical alignment of the stacked, horizontal cross-members 120 and further rigidify the support structure 100. The wing-like secondary ducts include cut-outs 123 which are dimensioned for receiving the vertical column members 130.

Figure 4:
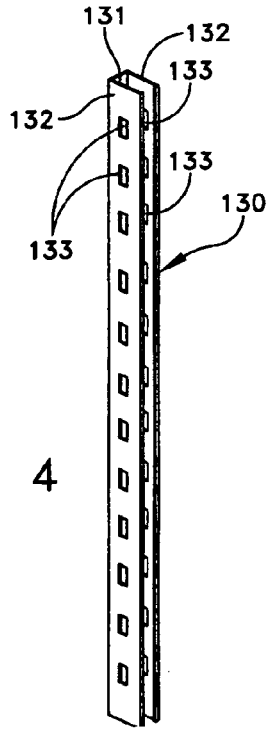
FIG. 4 is a perspective view showing a vertical column member of the antenna's support structure.

Referring to FIG. 4, the channel-like vertical column members 130 of the support structure 100 are each formed by bottom wall 131 and two depending side walls 132. The side walls 132 each include openings 133 which are positioned to communicate with each of the bays 140 so that the vertical column members 130 may also operate as raceways for bus networks that distribute DC power, control, and RF signal to the modular active electronics assemblies 200 disposed in the bays 140.

Figure 5:
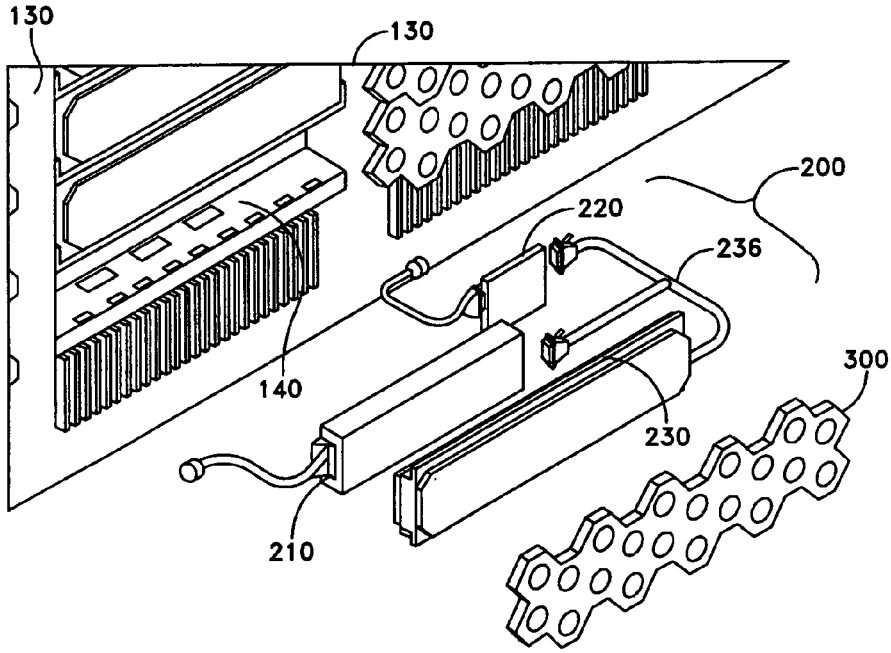
FIG. 5 is an enlarged perspective view showing a modular, active electronics assembly and a modular passive radiating element aperture panel of the antenna.

Referring to FIG. 5, the modular active electronics assemblies 200 each of which includes a high power density DC to DC converter 210, a panel electronics digital controller 220, and a multichannel transmitter/receiver (TIR) assembly 230, and the modular aperture panels 300 are integrated into the array as line replaceable units. The DC converter 210 and the digital controller 220 are disposed end to end in the innermost portion of each of the bays 1440 of the support structure 100 and may be secured by conventional fasteners. The DC converter 210 and the digital controller 220 are plugged into power and control signal buses disposed in the vertical column members 130.

Referring again to FIG. 3, the DC converter 210 includes a heat exchanger 211 that is aligined with the inner air metering, apertures 122*c* of two of the horizontal cross-members' secondary ducts 122 that are immediately above and below the DC converter 210 in the bay 140 (one of the two cross-members 120 operates as an "intake" air duct and the other one operates as an "exhaust" air duct). Compliant gaskets 240 are provided for sealing the DC converter's heat exchanger 211 to the secondary ducts 122 of these two cross-members 120 to prevent coolant leakage between the secondary ducts 122 and the heat exchanger 211. Cooling intake air ducted through the main and secondary ducts 121, 122 of the "intake" horizontal cross-member 120 (the cross-member 120 below the DC converter 210 in the shown embodiment) passes through the cross-member's inner air metering apertures 122*c* (the inner air metering apertures 122*c* that communicate with that DC converter's bay 140) into or across the fins or grid comprising the DC converter's heat exchanger 211. The air (which now contains the heat drawn away from the heat exchanger 211) is exhausted through the inner air metering apertures 122*c* of "exhaust" air horizontal cross-member's secondary duct 122 (the cross-member 120 above the DC converter 210 in the shown embodiment) and exhausted through the main duct 121 thereof.

Figure 6:
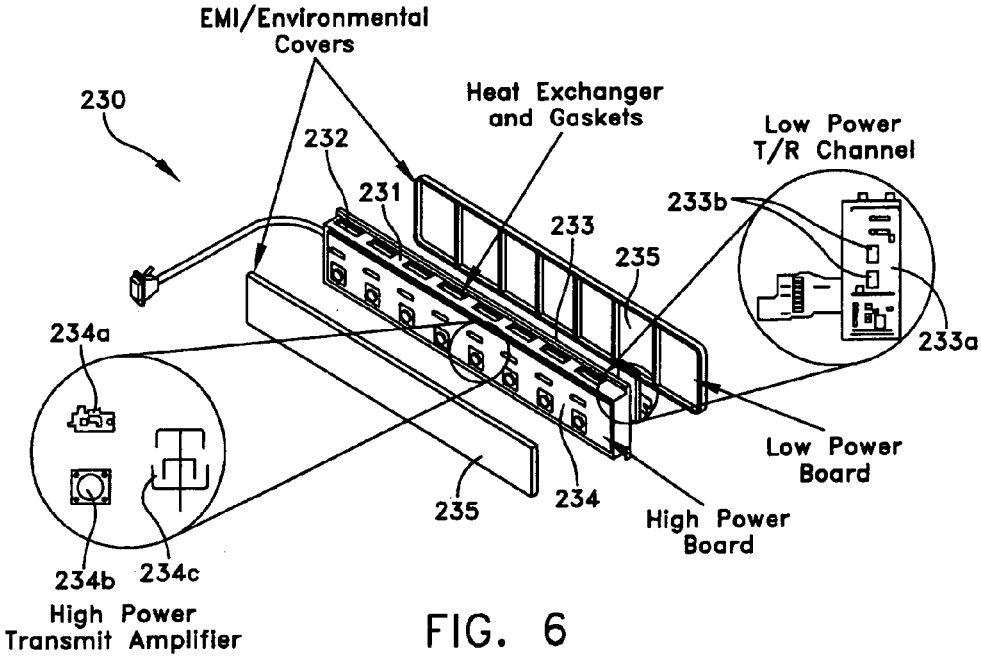
FIG. 6 is an exploded perspective view of a multichannel transmitter/receiver (T/R) assembly which forms one of the antenna's modular, active electronics assemblies.

Referring to FIG. 6, the T/R assemblies 230 are constructed as two-sided tile-assemblies to minimize the depth of the phased array antenna. Specifically. each T/R assembly 130 comprises a heat exchanger 231 formed by an extruded or cast metal structure having a plurality of transverse air passages 232 extending therethrough, a conventional low power circuit board 233 forming a low power T/R channel is mounted on a first side surface of the heat exchanger 231, and a conventional high power circuit board 234 forming a high power transmit amplifier is mounted on a second opposite side surface of the heat exchanger 231. The low power circuit board 233 forming the T/R channel may include, without limitation, multi-layer interconnect circuits 233*a* and microwave monolithic integrated circuits (MMICs) 233*b*. The high power circuit board 234 forming the high power transmit amplifier may include, without limitation, a Si bi-polar junction transistor (BJT) 234*a,* a circulator 234*b,* and a band pass filter 234*c*. Because TIR assemblies 230 are well known to those skilled in the art, a further discussion of tile details of the low and high power circuit boards are unnecessary herein.

Still referring to FIG. 6, covers 235 for shielding the low and high power circuit boards 233, 234 from electromagnetic interference and the environment are disposed over the circuit boards 233, 234. Each T/R assembly 230 is disposed in the outermost portion of the bay 140 and may be secured by conventional fasteners and plugged into the array antenna's RF bus disposed in the vertical column members 130. The T/R assembly 230 is also connected to the DC converter 210 and controller 220 disposed in the innermost portion of the corresponding bay 140 via plunge-style connectors or a short cable 236.

Referring again to FIG. 6 and FIG. 3, the transverse air passages 232 of the T/R assembly's heat exchanger 231 are aligned with the outer air metering apertures 122*d* of the two horizontal cross-members' secondary ducts 122 that are immediately above and below the T/R assembly 230 in the bay 140. Compliant gaskets are provided for sealing the T/R assembly's heat exchanger to the secondary ducts of these cross-members to prevent coolant leakage between the secondary ducts 122 and the T/R heat exchanger 231. As with the DC converter 210, cooling intake air ducted through the main and secondary ducts 121, 122 of the "intake air" horizontal cross-member 120 passes through that cross-member's outer air metering apertures 122*d* and through the transverse air passages 232 of the T/R assembly's heat exchanger 231. The heated air is exhausted through the outer air metering apertures 122*d* of "exhaust air" horizontal cross-member's secondary duct 122 and exhausted through its main duct 121.

As one of ordinary skill in the art will appreciate, the vertical stack of duct-like horizontal cross-members 120 provide a reliable and effective means for cooling the electronics assemblies 200. The specialized connections, leak issues, and air purge requirements associated with conventional liquid cooled methods are obviated with the phased array antenna of the present invention.

Referring again to FIG. 5, the modular aperture panels 300 each comprise a plurality of radiating elements. Their associated feed networks and optional signal sampling couplers which provided for a calibration system, are realized in the multiple layers of the panels 300. The modular aperture panels 300 also comprising a plurality of RF signal input ports that may be embodied, for example, as RF plunge-style connectors 301 (FIG. 3), so that when the panels 300 are attached at their periphery to the edges of the horizontal cross-members 120 and vertical column members 130 on one or both sides 101, 102 of the array antenna's support structure 100, direct connections are made to the T/R assemblies 230.

While the foregoing invention has been described with reference to the above, various modifications and changes can be made without departing from the spirit of the invention. Accordingly, all such modifications and changes are considered to be within the scope of the appended claims.

What is claimed is:

1. A lightweight support structure for mounting components of an active phased array antenna, the support structure comprising:

a frame;

at least two duct-like cross members secured by the frame; and at least one column member cooperating with the frame and the at least two duct-like cross members to define an array of bays for mounting the components of an active phased array antenna;

wherein the at least two duct-like cross members are for distributing a coolant to and from the components of the active phased array antenna.

2. The support structure according to claim 1, wherein the frame comprises a perimeter frame.

3. The support structure according to claim 2, wherein the perimeter frame comprises a plurality of frame members.

4. The support structure according to claim 1, further comprising at least one fan for moving the coolant through the at least two duct-like members.

5. The support structure according to claim 1, wherein the at least two duct-like cross members are stacked on top of one another.

6. The support structure according to claim 1, wherein at least one of the frame, the at least two duct-like members, and the at least one column member is fabricated from a material selected from the group consisting of carbon-epoxy composites and low mass density metal alloys.

7. The support structure according to claim 1, wherein each of the frame, the at least two duct-like members, and the at least one column member is fabricated from a material selected from the group consisting of carbon-epoxy composites and low mass density metal alloys.

8. The support structure according to claim 1, wherein at least one of the frame and the at least two duct-like members is fabricated from a material selected from the group consisting of carbon-epoxy composites and low mass density metal alloys.

9. The support structure according to claim 1, wherein the frame and the at least two duct-like members are fabricated from a material selected from the group consisting of carbon-epoxy composites and low mass density metal alloys.

10. A lightweight active phased array antenna comprising:

a support structure having at least two duct-like cross-members;

at least one electronics assembly disposed in the support structure; and at least one passive radiating element aperture panel disposed in the support structure, wherein the at least two duct-like members distribute a coolant to and from the components of the active phased array antenna, and the support structure further comprises at least one column member cooperating with the at least two duct-like cross members to define at least one bay for mounting the at least one electronic assembly.

11. The antenna according to claim 10, wherein the support structure further includes a frame for securing the at least two duct-like cross members.

12. The antenna according to claim 11, wherein the frame comprises a perimeter frame.

13. The antenna according to claim 12, wherein the perimeter frame comprises a plurality of frame members.

14. The antenna according to claim 10, wherein the support structure further comprises at least one fan for moving the coolant through the at least two duct-like members.

15. The antenna according to claim 10, wherein the at least one bay mounting the at least one electronic assembly is disposed on a side of the support structure so as to define a single-face array antenna.

16. The antenna according to claim 10, wherein the at least one bay mounting the at least one electronic assembly comprises at least two bays and at least two electronics assemblies, the at least two bays respectively mounting the at least two electronic assemblies are disposed on opposite sides of the support structure so as to define as dual-face array antenna.

17. The antenna according to claim 10, wherein the at least two duct-like cross members are stacked on top of one another.

18. The antenna according to claim 10, wherein the support structure further includes a frame for securing the at least two duct-like cross members.

19. The antenna according to claim 18, wherein at least one of the frame, the at least two duct-like members, and the at least one column member is fabricated from a material selected from the group consisting of carbon-epoxy composites and low mass density metal alloys.

20. The antenna according to claim 18, wherein each of the frame, the at least two duct-like members, and the at least one column member is fabricated from a material selected from a group consisting of carbon-epoxy composites and low mass density metal alloys.

21. The antenna according to claim 11, wherein at least one of the frame and the at least two duct-like members is fabricated from a material selected from the group consisting of carbon-epoxy composites and low mass density metal alloys.

22. The antenna according to claim 11, wherein each of the frame and the at least two duct-like members is fabricated from a material selected from the group consisting of carbon-epoxy composites and low mass density metal alloys.

23. The antenna according to claim 10, wherein the at least two duct-like members are fabricated from a material selected from the group consisting of carbon-epoxy composites and low mass density metal alloys.

24. The antenna according to claim 10, wherein at least one electronics assembly is readily accessible from a face of the antenna.

25. The antenna according to claim 10, wherein at least one electronics assembly includes a DC power converter.

26. The antenna according to claim 25, wherein the DC power converter includes a heat exchanger in communication with the at least two duct-like members, the coolant distributed by the at least two duct-like members passing through the heat exchanger.

27. The antenna according to claim 10, wherein the at least one electronics assembly includes a transmit/receive electronics.

28. The antenna according to claim 27, wherein the transmit/receive electronics includes a heat exchanger in communication with the at least two duct-like cross members, the coolant distributed by the at least two duct-like members passing through the heat exchanger.

29. The antenna according to claim 10, wherein the at least one electronics assembly includes a heat exchanger in communication with the at least two duct-like cross-members, the coolant distributed by the at least two duct-like members passing through the heat exchanger.

30. The antenna according to claim 10, further comprising a bus network for power, RF signals, and control signals, the bus network routed within the at least one column member.

* * * * *